US006039443A

United States Patent [19]

Dunphy et al.

[11] Patent Number: 6,039,443

[45] Date of Patent: Mar. 21, 2000

[54] APPARATUS AND METHOD OF PRIMING INK SUPPLY TUBES IN AN INK JET PRINTER

[75] Inventors: Katherine Ann Dunphy, Lafayette, Ind.; Susan T Schnapp, Vancouver, Wash.; David C Johnson, Portland, Oreg.

[73] Assignee: Hewlett-Packard Company, Palo Alto, Calif.

[21] Appl. No.: 08/990,156

[22] Filed: Dec. 12, 1997

[51] Int. Cl.[7] ..... B41J 2/19

[52] U.S. Cl. ..... 347/92

[58] Field of Search ..... 347/92, 35, 85, 347/86, 87

[56] References Cited

U.S. PATENT DOCUMENTS

| | | | |
|---|---|---|---|
| 4,510,510 | 4/1985 | Terasawa | 347/30 |
| 4,628,333 | 12/1986 | Terasawa | 347/30 |
| 4,847,637 | 7/1989 | Watanabe et al. | 347/30 |
| 5,185,614 | 2/1993 | Courian et al. | 347/30 |
| 5,506,611 | 4/1996 | Ujita et al. | 347/86 |
| 5,774,154 | 6/1998 | Underwood | 347/85 |
| 5,847,734 | 12/1998 | Pawlowski et al. | 347/86 |

FOREIGN PATENT DOCUMENTS

| | | | |
|---|---|---|---|
| 84/02841 | 8/1984 | WIPO | 141/18 |

*Primary Examiner*—N. Le
*Assistant Examiner*—Michael Nghiem

[57] ABSTRACT

An ink jet printer with a body defining a paper path and a carriage operable to reciprocate across the paper path. An ink supply receptacle on the body is spaced apart from the carriage, and an ink conduit extends between the ink supply receptacle and the carriage. A suction apparatus on the carriage has an expandable chamber with an inlet connected to the conduit, and moves between a collapsed position and an expanded position, such that ink may be drawn from an ink supply connected to the receptacle to displace at least some of the air from the tube. The chamber may be spring biased to the expanded position, and constrained to the collapsed position during shipping, so that removal of the constraint after installation of ink supplies will draw ink into the conduit to displace air. The suction apparatus may also be installed in a position on the carriage later to be occupied by the print head.

16 Claims, 4 Drawing Sheets

FIG. 4
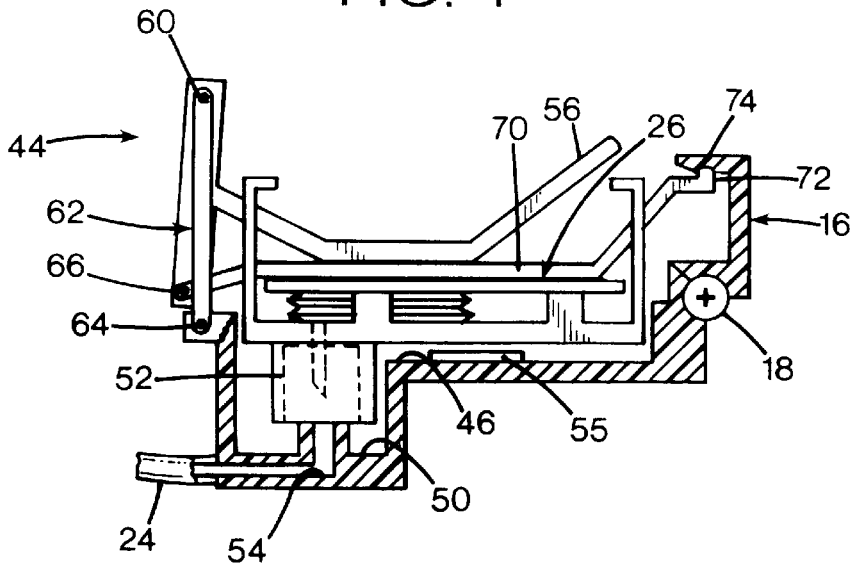
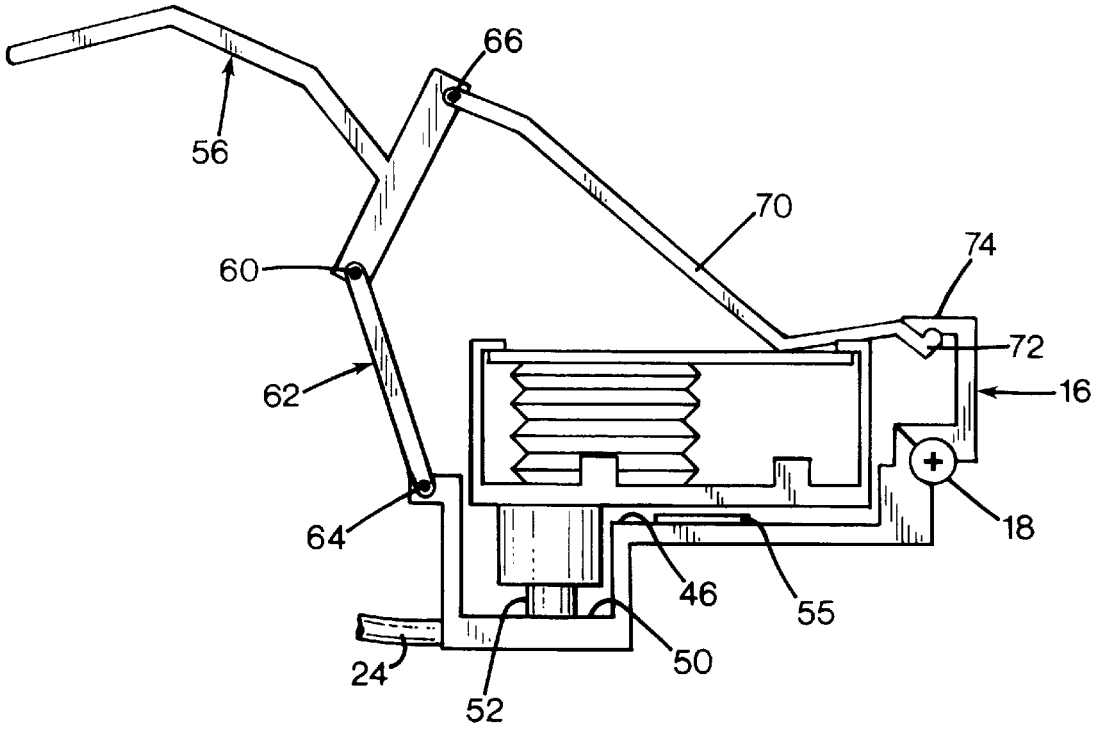
FIG. 5

APPARATUS AND METHOD OF PRIMING INK SUPPLY TUBES IN AN INK JET PRINTER

FIELD OF THE INVENTION

This invention relates to ink jet printers, and particularly to ink jet printers with remote ink supplies.

BACKGROUND AND SUMMARY OF THE INVENTION

A typical ink jet printer has a pen that reciprocates over a printable surface such as a sheet of paper. The pen includes a print head having an array of numerous orifices through which droplets of ink may be expelled onto the surface to generate a desired pattern. Some ink jet printers have a replaceable ink supply mounted to a stationary position on the printer, and connected to a reciprocating print head by a conduit. This permits the use of a larger ink supply, and avoids the need to replace the print head each time the supply of ink is depleted. Color ink jet printers generally have several ink supply cartridges each containing a different color of ink, or a multi-chamber cartridge.

Printers with remote or "off axis" ink supplies are normally shipped with the ink supplies and print head removed. The ink conduit is empty, open to ambient air, or in a "dry" condition. This avoids potential leakage of the ink and shelf life reduction that begins when the seal of an ink supply cartridge is penetrated. More significantly, if ink were to remain in the ink conduit for an extended period between manufacturing and first use, air may be absorbed by the ink, and water evaporated. This would undesirably change the consistency of the ink beyond normal parameters. In addition, the print head may be protected in special packaging against potential shocks during shipping. When printers are shipped "dry," the ink conduits are empty, except for the presence of ambient air.

When setting up such a printer for its first use, as ink flows from the ink supply to the print head and its on-board reservoir, the air volume within the ink tube is forced into the print head reservoir. If the reservoir is sufficiently large, this can be readily accommodated, but leaves a substantial air volume in the reservoir. Thereafter, ambient pressure or temperature variations, such as caused by changing weather or air travel, can generate pressure changes in the air bubble that undesirably force ink from the orifices. The consequences of such leakage or "drool" include user inconvenience, printer damage, and impaired printing.

The present invention overcomes the limitations of the prior art by providing an ink jet printer with a body defining a paper path and a carriage operable to reciprocate across the paper path. An ink supply receptacle on the body is spaced apart from the carriage, and an ink conduit extends between the ink supply receptacle and the carriage. A suction apparatus on the carriage has an expandable chamber with an inlet connected to the conduit, and moves between a collapsed position and an expanded position, such that ink may be drawn from an ink supply connected to the receptacle to displace at least some of the air from the tube. The chamber may be spring biased to the expanded position, and constrained to the collapsed position during shipping, so that removal of the constraint after installation of ink supplies will draw ink into the conduit to displace air. The suction apparatus may also be installed in a position on the carriage later to be occupied by the print head.

BRIEF DESCRIPTION OF THE DRAWINGS

FIGS. 4 and 5 are sectional side view of a printer carriage and suction apparatus according to the embodiment of FIG. 1.

DETAILED DESCRIPTION OF A PREFERRED EMBODIMENT

Figure 1:
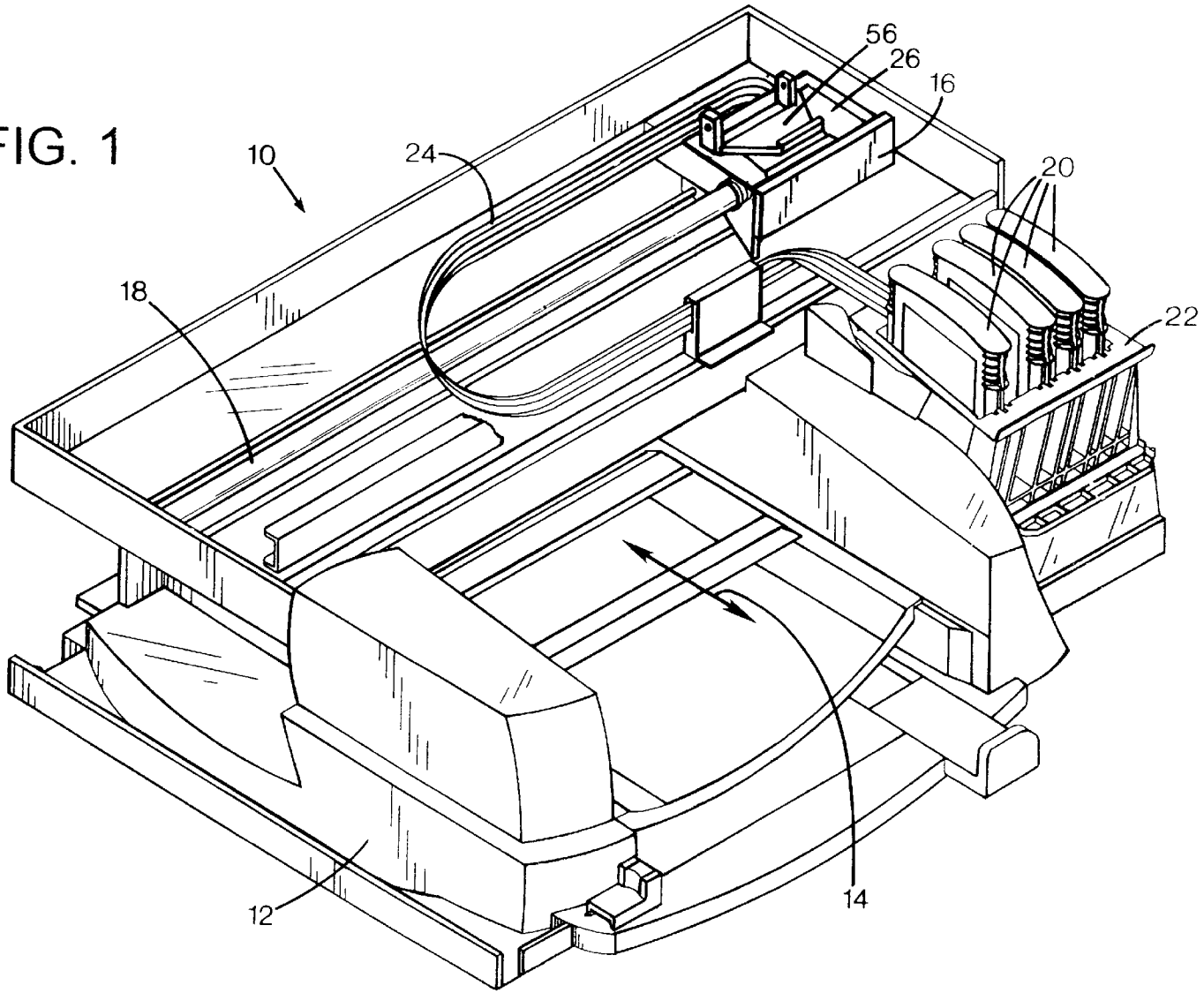
FIG. 1 is a perspective view of a printer according to a preferred embodiment of the invention.

FIG. 1 shows an ink jet printer 10 having a housing 12. A paper path 14 runs through the housing below a carriage assembly 16 that reciprocates along a rail 18. Four or more ink supply cartridges 20, each of a different color, are received in a stationary ink supply receptacle 22 defined in the housing. A flexible ink supply tube 24 defining four conduit passages, each connected to a respective one of the ink cartridges, extends in an arc to the carriage 16, and to a suction device 26 connected to the carriage. Although the printer is shipped without the ink cartridges installed, the illustration shows the printer's condition just after the ink cartridges have been installed by a user, the first step in preparing the printer for operation.

Figure 2:
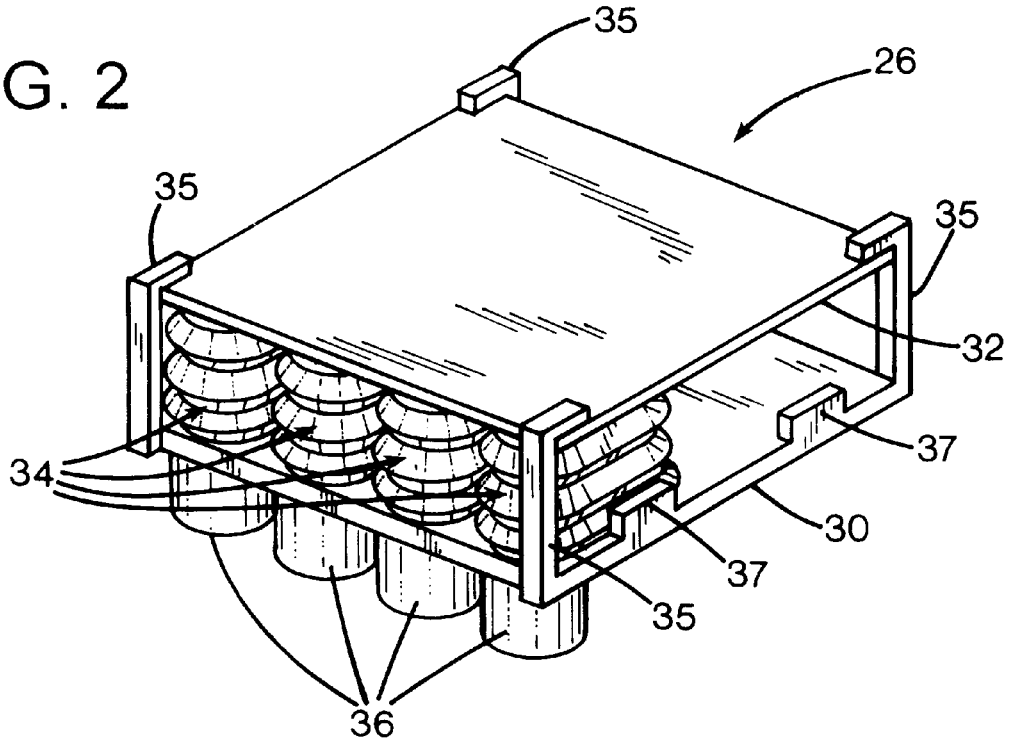
FIG. 2 is a perspective view of a suction apparatus according to the embodiment of FIG. 1.

FIG. 2 shows the suction apparatus 26, which has a rectangular lower plate 30 and a similar upper plate 32 spaced apart from each other. The plates are connected to each other by four flexible bellows 34, each having an oblong cross section as viewed from above and sealed at each end to a respective plate to define four independent chambers. Each bellows is at rest in the expanded position shown, and the bellows act as springs to resist compression, and to restore their expanded shape when a compressive force is released. Alternatively, a spring may be provided to further bias apart the plates. The ridged shape of the bellows further prevents collapse of the side walls when there is a negative pressure in the chambers. Alternative bellows arrangement may include telescoping cylinders, or sleeve-wrapped coil springs. The upper plate edges function as a handle for a user to grip the apparatus and extract it from the carriage. Such extraction forces supplement the spring effects of the bellows. In an alternative embodiment, a foldable bail or handle may be connected to the upper plate to assist extraction.

To limit the expansion and compression of the bellows, a set of expansion limiting elements 35 connected to the lower plate 30 extend upwardly from the corners of the lower plate, and have overhangs against which the upper surface of the upper plate 32 presses when in the expanded position. This permits the bellows or auxiliary spring to be designed with a substantial spring force to provide substantial suction for rapidly drawing fluid, without excessive excursions on expansion that might interfere with other functions, such as latching. A set of compression limiting elements 37 along opposite edges of the lower plate limits the downward excursion of the upper plate, avoiding excessive compression of the bellows. Together, the expansion and compression limiting elements provide a precisely calibrated volume differential in the bellows, which allows the suction apparatus to be designed for adequate but not excessive suction capacity. The limiting elements are optional, and are omitted from some figures for simplicity and clarity.

Figure 3:
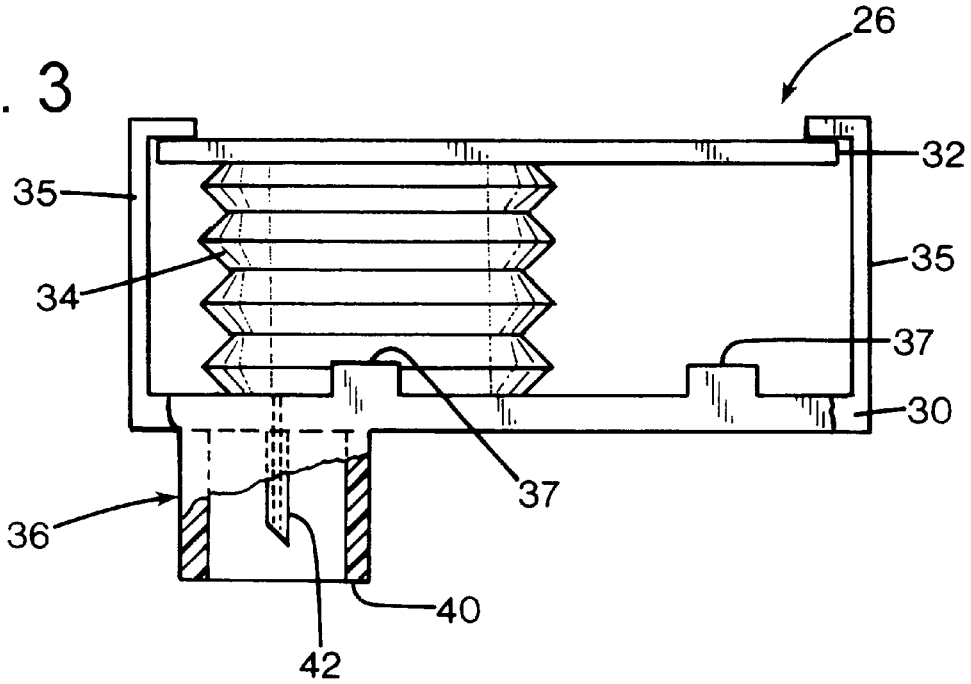
FIG. 3 is a side view of the suction apparatus of FIG. 2.

As shown in FIG. 3, the lower plate has a downwardly-depending inlet portion 36 corresponding to each bellows. Each inlet portion includes a rigid cylindrical shroud 40 that shields a hollow needle 42 extending perpendicularly from the plane of the lower plate, and concentrically with the shroud. The needle defines a bore that opens into the chamber of the bellows, providing the only air or fluid access to the chamber.

FIG. 4 shows the suction apparatus 26 installed in the carriage 16 as shipped to a user. The suction apparatus is in a collapsed condition in which the plates 30, 32 are biased together and constrained in the collapsed position by a latch mechanism 44. The carriage defines a pen receptacle 46 in which the suction apparatus is received. A lower portion 50 of the receptacle receives the inlet shroud, and has an upwardly protruding standpipe 52 sealed at its upper end by a septum. The septum may be penetrated by the needle to provide fluid communication between the chamber and an inlet passage 54 connected to one portion of the ink supply tube 24. An electrical interconnect 55 in the carriage's pen receptacle permits connection of an ink jet pen to the printer's circuitry, and is connected via a flexible circuit strip similar to the flexible conduit, permitting the carriage to reciprocate in the printer.

The latch mechanism 44 is a four bar linkage having a latch arm 56 connected at one pivot 60 to a link 62 that connects to a pivot 64 on the carriage. A second pivot 66 on the latch arm connects to an elongated restraint plate 70 that rests flat against the top plate of the suction apparatus when the latch mechanism is in the latched position shown. The restraint plate has a free end 72 that is captured under a ledge 74 of the carriage to provide downforce. The arrangement of the pivot points of the latch arm 56 and link 62 provide a stable over center function, so that a moderate force on the latch arm is required to release the mechanism as shown in FIG. 5.

When the mechanism is released from the latched condition to a released condition, link 62 swings away from the carriage. Pivot 66 is permitted to swing upward, elevating pivot 66 and the restraint plate 70. The bellows are released to expand to the expanded condition under their own spring force. As the restraint plate lifts away from the top plate of the suction apparatus, the free end 72 of the restraint plate disengages from the carriage ledge 74, and is permitted to swing away to allow removal of the expanded suction apparatus. Installation of the suction apparatus upon manufacturing proceeds by the reverse process: installation in the carriage, engagement of the free end of the restraint plate under the carriage ledge, actuation of the latch to the latched position, which compresses the bellows. Such a procedure may also be used any time the ink tube 24 must be replaced, by reusing the original suction apparatus, or by using a similar device that may be provided with the tube.

Figure 6:
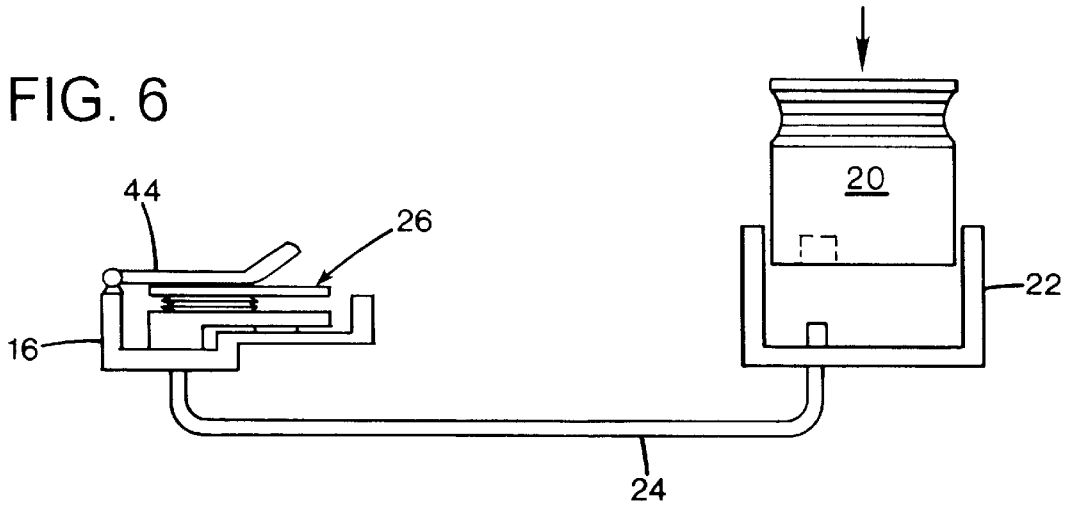
FIGS. 6–8 are simplified schematic views of a sequence of operation of the apparatus of FIG. 1.
Figure 7:
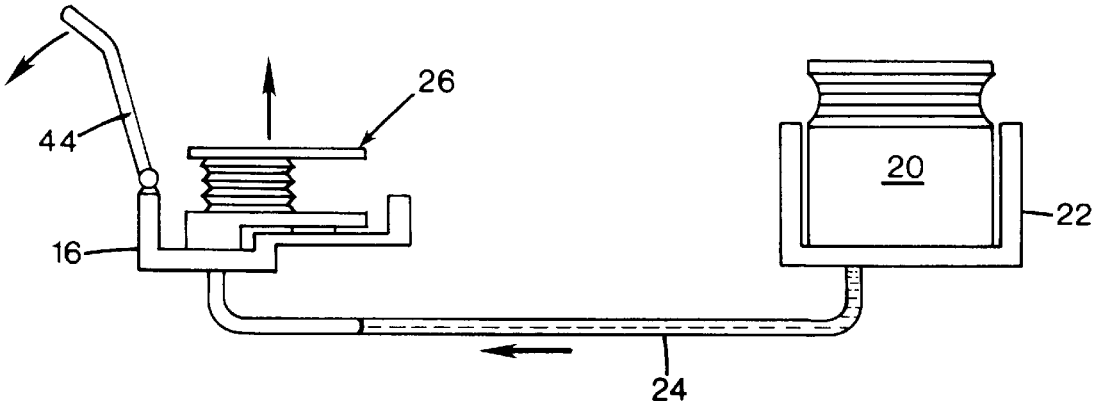
Figure 8:
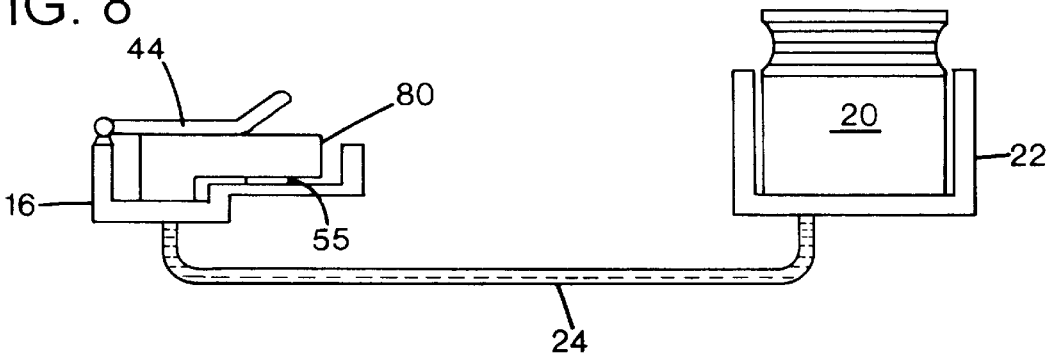

FIGS. 6, 7, and 8 show a sequence of operations using the suction apparatus. During manufacturing, the apparatus is installed in the carriage, the latch mechanism 44 (shown symbolically for simplicity) is moved to the latched position, and the printer is shipped with the ink supply cartridges 20 and pens uninstalled, and in appropriately protective packaging to protect against damage, and to reduce ink evaporation or air incursion.

After the printer is received, the user is instructed to install the ink supply cartridges 20 as shown. After the printer detects that the cartridges are in place, the printer permits the suction apparatus to be activated. This permission may be granted by providing a message from the user's computer, by a signal or display on the printer or, preferably, by keeping the carriage in, an inaccessible location in the printer until the ink supplies are installed, after which the carriage is automatically moved to an accessible position.

The user grasps the free end of the latch mechanism, releasing it as shown in FIG. 7, and permitting the bellows to expand. Upon this expansion, the spring forces causing the bellows to restore their original shape generates a partial vacuum that communicates through the tube 24 to the ink supply cartridge. Because the bellows/tube/supply system is closed, the expanding volume of the bellows is filled by air from the tube, which is filled at least partially with ink from the supply. The ink supply is designed not to present a substantial back pressure under this suction.

With the ink tubes at least partially filled with ink, the remaining air volume is reduced to tolerable levels. After the suction apparatus is fully expanded, it is removed from the carriage. Then, the ink jet pens 80 are installed to connect with the ink supply tube and with the electrical connector 55. The same latch mechanism 44 is used to secure the pens in the carriage for printing.

Because each pen has an on-board reservoir, the remaining air in the tube may tolerably be drawn into the pen during initial printing, and retained in the reservoir along with ink. Because the size of this bubble is small relative to the volume of such a reservoir, environmental pressure changes are more readily tolerated without ink being "drooled" from the pen's orifices. In the preferred embodiment, it has been found tolerable to draw up to 1.0 cc of air from each tube passage into the corresponding pen. Each passage has a volume of 1.3 cc, so at least 0.3 cc of ink must be drawn into each tube. In the preferred embodiment, the bellows have a 0.5 cc volume difference each between the expanded and collapsed conditions, providing adequate printing of the tubes. In alternative embodiments in which less or no air bubbles are tolerable, the bellows volume may be designed to exceed the tube volume, so that no air remains in the tubes, and so that a small amount of ink is drawn into each chamber.

While the above is discussed in terms of preferred and alternative embodiments, the invention is not intended to be so limited. For instance, the four bellows may be replaced by a single large common bellows, with check valves being provided to prevent back flow of one ink into another ink tube. Also, the spring biased or self biased expansion of the bellows may be replaced by active expansion of the bellows by an external force. For example, the latch mechanism may provide adequate tension on the bellows, or a handle may be provided on the top plate so that the manual force of extraction of the suction apparatus by the user will provide or enhance the force needed to expand the chambers.

We claim:

1. An ink jet printer comprising:

a body defining a paper path and having a carriage operable to reciprocate across the paper path;

an ink supply receptacle on the body and spaced apart from the carriage;

an ink conduit extending between the ink supply receptacle and the carriage;

a suction apparatus on the carriage defining an expandable chamber having an inlet connected to the conduit and operable between a collapsed position and an expanded position, such that ink may be drawn from an ink supply connected to the receptacle to displace at least some of the air from the conduit; and wherein the carriage defines a pen receptacle including an electrical connection to printer circuitry, and wherein the suction apparatus is received in the pen receptacle, such that the suction apparatus must be removed from the carriage before a pen is installed in the pen receptacle.

2. The printer of claim 1 wherein the suction apparatus has a first portion mounted stationary relative to the carriage, and has a second portion movable relative to the first portion to change the volume of the chamber.

3. The printer of claim 2 including a handle connected to the second portion, such that pulling on the handle to remove the device moves the second portion relative to the first portion to change the volume of the chamber.

4. The printer of claim 1 wherein the chamber is biased toward the expanded position.

5. The printer of claim 1 including a movable chamber restraint element connected to the carriage and contacting the chamber to maintain the chamber in the collapsed position.

6. The printer of claim 5 wherein the restraint element is movable between a restraining position in which expansion of the chamber is prevented, and a released positioning which expansion of the chamber is permitted.

7. The printer of claim 1 wherein the printer is a color printer having a plurality of conduit passages connectable to different color ink supplies, and wherein the suction apparatus includes a plurality of separate chambers, each connected to a different conduit passage.

8. The printer of claim 1 wherein the suction apparatus includes a bellows having separable end portions and flexible side portions.

9. The printer of claim 8 wherein the bellows has circumferential ridges.

10. The printer of claim 1 wherein the ink conduit terminates at an ink outlet at the carriage, and the suction apparatus is connected to the ink outlet of the conduit.

11. A printing apparatus for an ink jet printer having a reciprocating pen carriage defining a pen receptacle and connected to a remote supply of ink by a conduit having an outlet end at the carriage, the printing apparatus comprising:

a body defining an expandable chamber movable between a collapsed position and an expanded position;

the body including inlet means connectable to the conduit outlet;

the body being removably connectable to the carriage to removably reside in the receptacle;

expansion means operable to move the chamber to the expanded position; and a movable actuator portion of the chamber operable to maintain the chamber in the collapsed position in response to constraining contact by a latch portion of the carriage.

12. The apparatus of claim 11 wherein the expansion means comprises a resilient compressible member.

13. The apparatus of claim 11 wherein the expansion means comprises a spring.

14. The apparatus of claim 11 wherein the chamber is biased to the expanded position.

15. The apparatus of claim 11 wherein the chamber includes a flexible bellows.

16. The apparatus of claim 11 wherein the body defines a plurality of chambers.

* * * * *